US010716363B1

(12) United States Patent
Masat

(10) Patent No.: US 10,716,363 B1
(45) Date of Patent: Jul. 21, 2020

(54) SHOELACE KNOT RETAINER

(71) Applicant: Linda Masat, Aurora, CO (US)

(72) Inventor: Linda Masat, Aurora, CO (US)

( * ) Notice: Subject to any disclaimer, the term of this patent is extended or adjusted under 35 U.S.C. 154(b) by 66 days.

(21) Appl. No.: 16/154,818

(22) Filed: Oct. 9, 2018

(51) Int. Cl.
*A43C 7/00* (2006.01)

(52) U.S. Cl.
CPC ..... *A43C 7/005* (2013.01)

(58) Field of Classification Search
CPC ... A45C 7/00; Y10T 24/3705; Y10T 24/3703; Y10T 24/3718; Y10T 24/3724
See application file for complete search history.

(56) References Cited

U.S. PATENT DOCUMENTS

| | | | | |
|---|---|---|---|---|
| 2,175,962 | A | 10/1939 | Kenifick | |
| 3,122,805 | A | 3/1964 | Hakim | |
| 3,176,362 | A | 4/1965 | Esther | |
| 4,428,101 | A | 1/1984 | Harkavy | |
| 4,949,437 | A | 8/1990 | Anderson | |
| 5,022,127 | A | 6/1991 | Ang | |
| 5,333,398 | A * | 8/1994 | Seo | A43C 7/00 24/712.9 |
| D367,755 | S | 3/1996 | Jones | |
| 5,572,778 | A * | 11/1996 | Stenner | A43C 7/00 24/712.7 |
| 5,649,342 | A | 7/1997 | d'Andrade | |
| 5,918,352 | A | 7/1999 | Gailbreath | |
| 5,953,800 | A * | 9/1999 | Duckett | A43C 7/00 24/129 R |
| 6,502,286 | B1 * | 1/2003 | Dubberke | A43C 7/00 24/712.1 |
| 2005/0172463 | A1 | 8/2005 | Rolla | |
| 2013/0174391 | A1 * | 7/2013 | Neale | A43C 7/08 24/712.9 |

FOREIGN PATENT DOCUMENTS

| | | |
|---|---|---|
| CA | 2020967 | 1/1991 |

* cited by examiner

*Primary Examiner* — Robert Sandy
*Assistant Examiner* — Rowland Do

(57) ABSTRACT

The shoelace knot retainer is configured for use with a shoelace. The shoelace knot retainer holds the shoelace in position after the shoelace has been tightened on the shoe. The shoelace knot retainer comprises a pedestal, a stanchion, and a sleeve. The pedestal is intermediate structure that transfers the load of the shoelace knot retainer to the surface of the shoe. The stanchion forms an anchor point around which the shoelace is wound. The shoelace is wound around the stanchion during the tightening process. The sleeve is an elastomeric structure. The stanchion and the shoelace insert into the sleeve such that the sleeve compresses around the shoelace thereby holding the shoelace in position. The stanchion is further formed with an accommodation that secures the tips of the shoelace to the stanchion.

14 Claims, 4 Drawing Sheets

SHOELACE KNOT RETAINER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including footwear, more specifically, a fastening and holding device for laces. (A43C7/00)

SUMMARY OF INVENTION

The shoelace knot retainer is configured for use with a shoelace. The shoelace knot retainer holds the shoelace in position after the shoelace has been tightened on the shoe. The shoelace knot retainer comprises a pedestal, a stanchion, and a sleeve. The pedestal is an intermediate structure that transfers the load of the shoelace knot retainer to the surface of the shoe. The stanchion forms an anchor point around which the shoelace is wound. The shoelace is wound around the stanchion during the tightening process. The sleeve is an elastomeric structure. The stanchion and the shoelace insert into the sleeve such that the sleeve compresses around the shoelace thereby holding the shoelace in position. The stanchion is further formed with an accommodation that secures the tips of the shoelace to the stanchion.

These together with additional objects, features and advantages of the shoelace knot retainer will be readily apparent to those of ordinary skill in the art upon reading the following detailed description of the presently preferred, but nonetheless illustrative, embodiments when taken in conjunction with the accompanying drawings.

In this respect, before explaining the current embodiments of the shoelace knot retainer in detail, it is to be understood that the shoelace knot retainer is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the shoelace knot retainer.

It is therefore important that the claims be regarded as including such equivalent construction insofar as they do not depart from the spirit and scope of the shoelace knot retainer. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
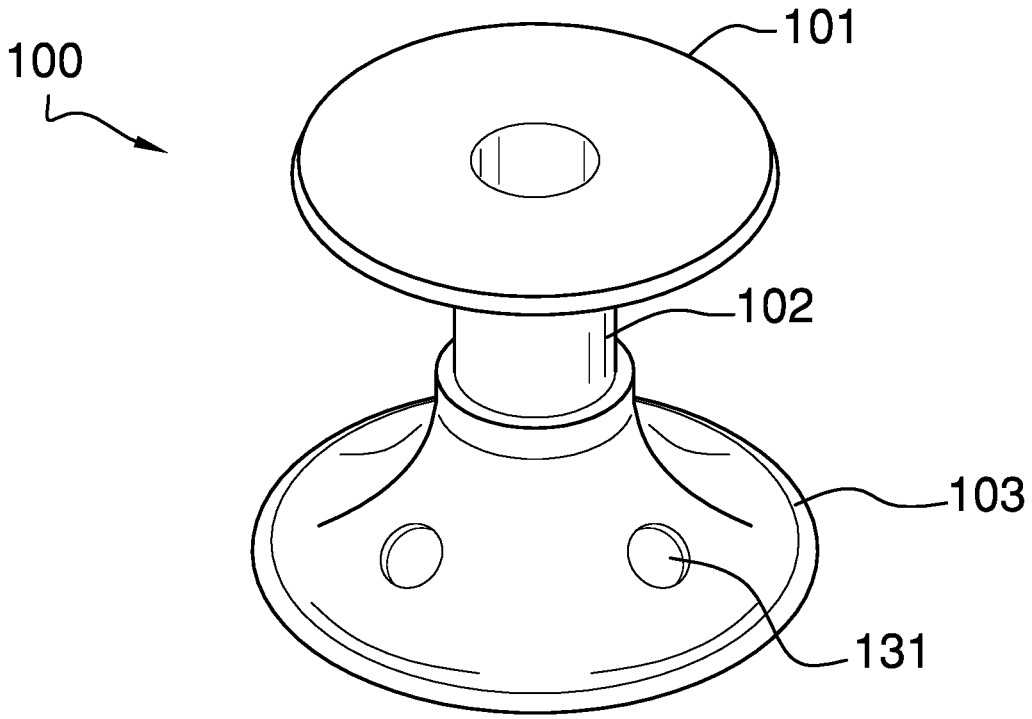
FIG. 1 is a reverse perspective view of an embodiment of the disclosure.
Figure 2:
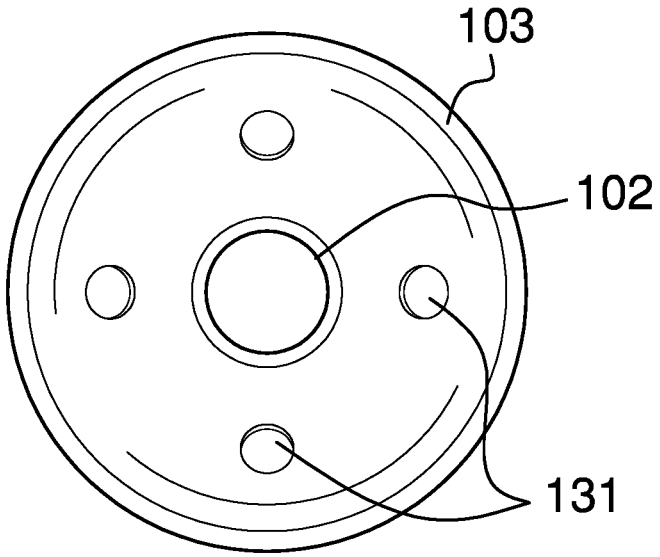
FIG. 2 is a top view of an embodiment of the disclosure.
Figure 3:
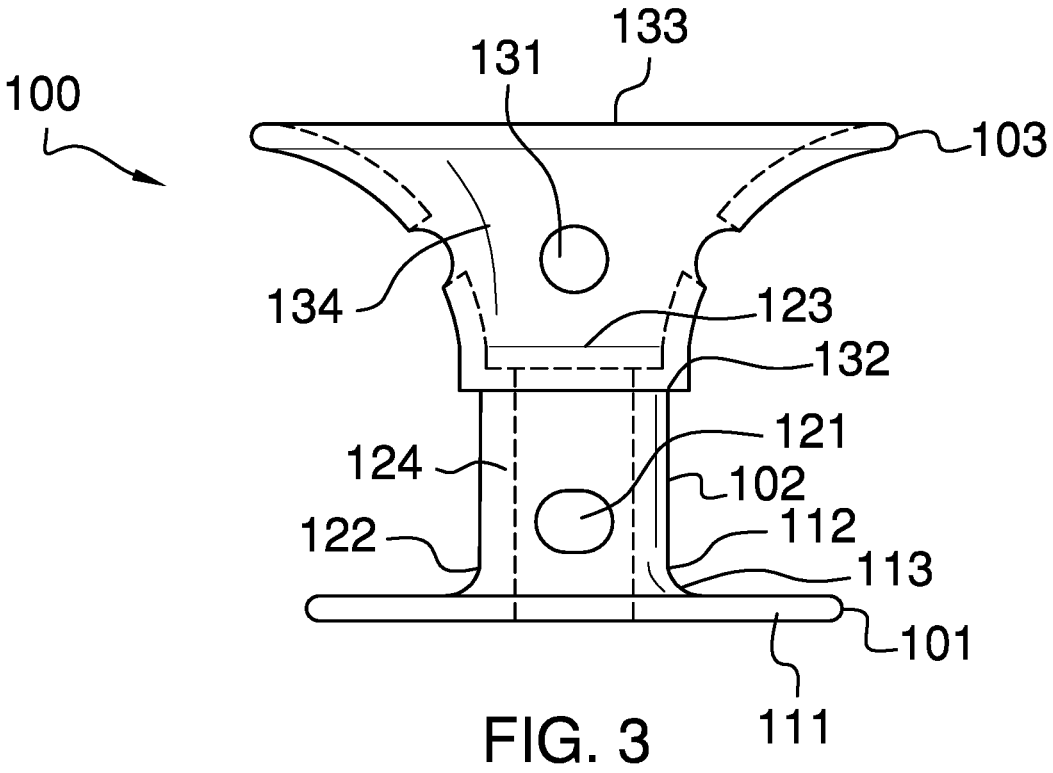
FIG. 3 is a front view of an embodiment of the disclosure.
Figure 4:
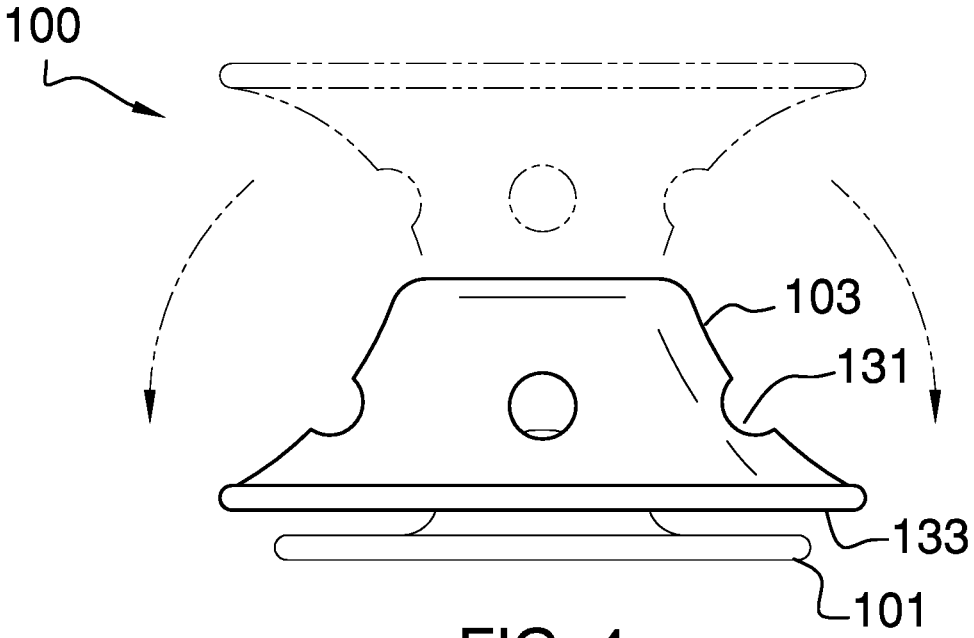
FIG. 4 is a detail view of an embodiment of the disclosure.
Figure 5:
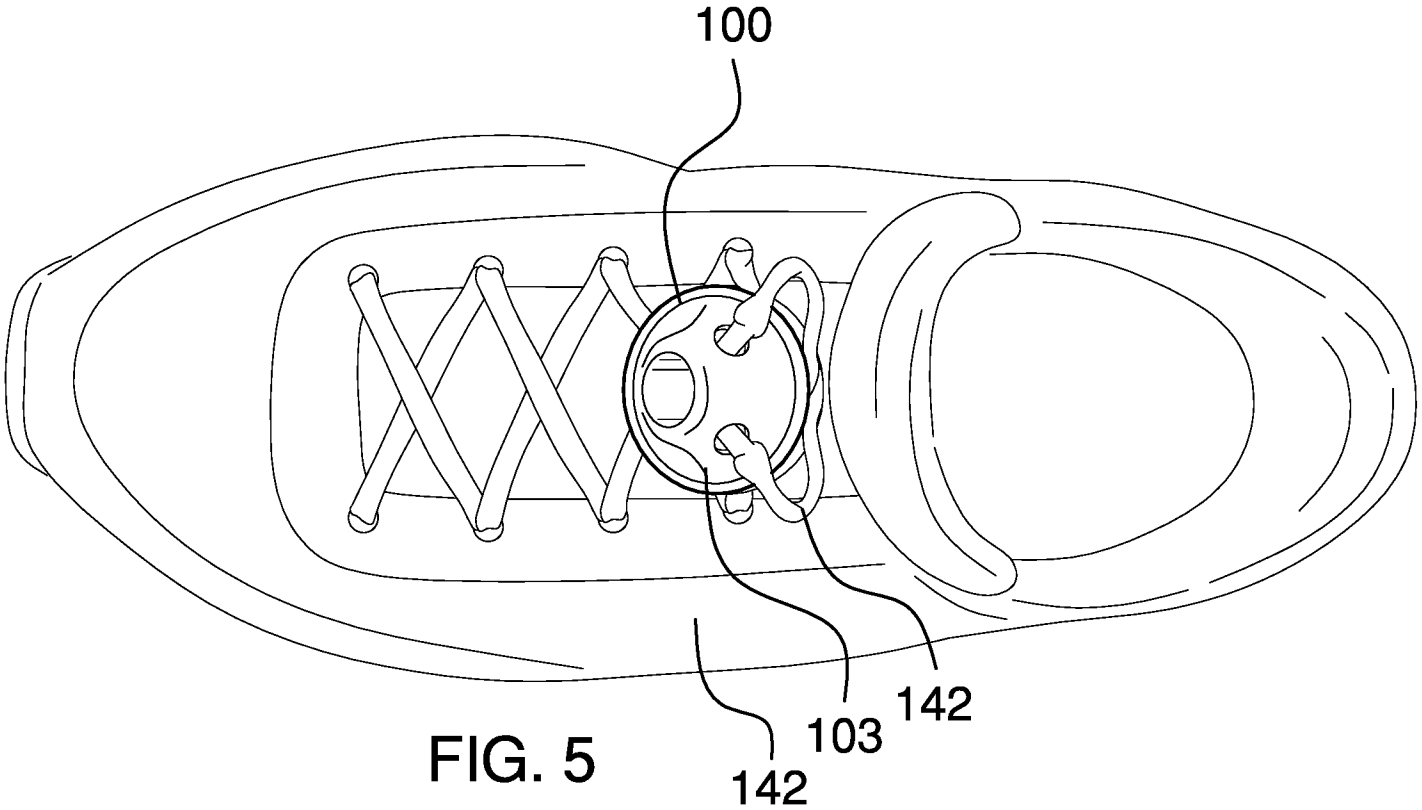
FIG. 5 is an in-use view of an embodiment of the disclosure.
Figure 6:
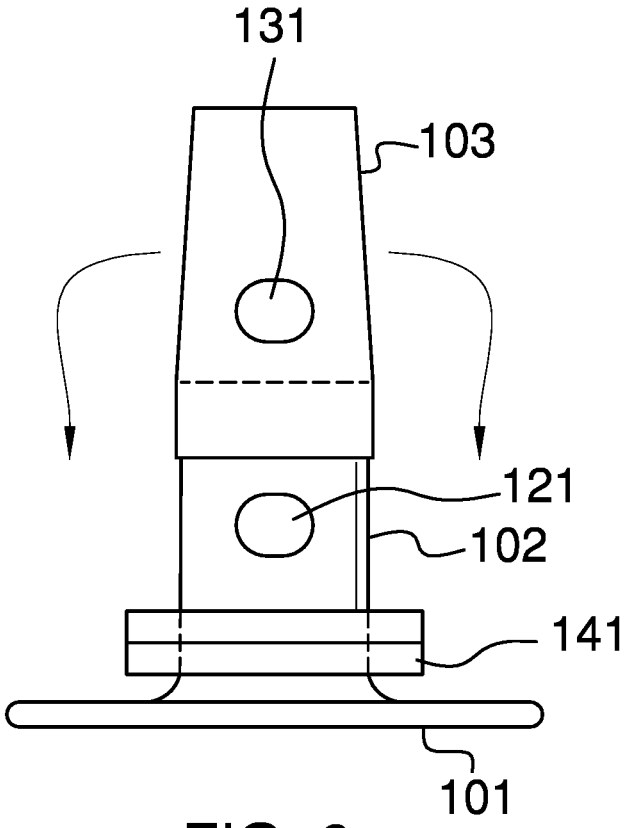
FIG. 6 is a detail in-use view of an embodiment of the disclosure.
Figure 7:
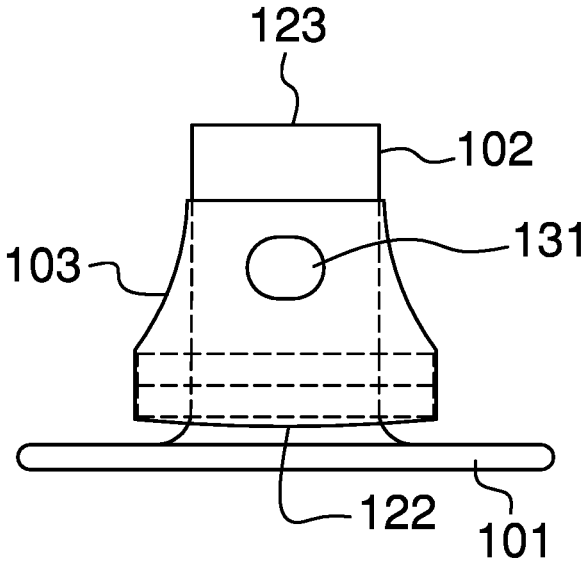
FIG. 7 is a detail in-use view of an embodiment of the disclosure.

Detailed reference will now be made to one or more potential embodiments of the disclosure, which are illustrated in FIGS. 1 through 7.

The shoelace knot retainer 100 (hereinafter invention) is configured for use with a shoelace 141. The invention 100 holds the shoelace 141 in position after the shoelace 141 has been tightened on a shoe 142. The shoe 142 is a footwear item. The shoelace 141 is a cord commonly used to tighten a shoe 142 to a foot. The invention 100 comprises a pedestal 101, a stanchion 102, and a sleeve 103. The pedestal 101 is an intermediate structure that transfers the load of the invention 100 to the surface of the shoe 142. The stanchion 102 attaches the pedestal 101 to the sleeve 103. The stanchion 102 forms an anchor point around which the shoelace 141 is wound. The shoelace 141 is wound around the stanchion 102 during the tightening process. The stanchion 102 is further formed with an accommodation that secures the tips of the shoelace 141 to the stanchion 102.

The sleeve 103 is an elastomeric structure. The sleeve 103 encloses the shoelace 141 and the stanchion 102. Specifically, the stanchion 102 and the shoelace 141 insert into the sleeve 103 such that the sleeve 103 compresses around the shoelace 141 thereby holding the shoelace 141 in position.

The pedestal 101 forms the structure of the invention 100 placed in contact with the shoe 142. The pedestal 101 has the shape of a truncated cone. The pedestal 101 is a rigid structure. The pedestal 101 is further defined with a base 111, a truncated apex 112, and a pedestal face 113.

The base 111 refers to the base 111 of the pyramid structure that forms the pedestal 101. The base 111 of the pedestal 101 rests on the shoe 142. The increased surface area of the base 111 relative to the truncated apex 112 of the pedestal 101 reduces the pressure applied to the shoe 142 by the load carried over the load path formed by the invention 100. The truncated apex 112 refers to the truncating plane formed in the pyramid structure that separates the apex of the pyramid from the pedestal 101. The truncated apex 112 is distal from the base 111. The pedestal face 113 refers to the surface structure of the pedestal 101 that joins the base 111 to the truncated apex 112.

The stanchion 102 is a hollow cylindrical structure. The stanchion 102 is a rigid structure. The stanchion 102 attaches to the pedestal 101 to form a composite prism structure. The stanchion 102 forms an anchor point around which the shoelace 141 winds in the manner of a cord loading on a spool. The stanchion 102 further comprises a plurality of lace ports 121. The stanchion 102 is further defined with an inferior end 122, a superior end 123, and a stanchion face 124.

The inferior end 122 refers to the end of the cylindrical structure of the stanchion 102 that attaches to the pedestal 101. The superior end 123 refers to the end of the cylindrical structure of the stanchion 102 that is distal from the inferior end 122. The stanchion face 124 refers to the surface structure of the stanchion 102 that joins the inferior end 122 to the superior end 123. The truncated apex 112 of the pedestal 101 attaches to the inferior end 122 of the stanchion 102. The shoelace 141 winds around the stanchion face 124 of the stanchion 102.

Each of the plurality of lace ports 121 is an aperture formed through the stanchion face 124 of the stanchion 102 into the hollow interior of the stanchion 102. Each of the plurality of lace ports 121 provides a location where the free tip of the shoelace 141 inserts for storage.

The sleeve 103 is a hollow tube structure. The sleeve 103 is an elastomeric structure. The sleeve 103 has a shape selected from the group consisting of a cylindrical structure and an hourglass structure. The sleeve 103 is formed from an elastic sheeting. The sleeve 103 attaches to the stanchion 102 to form a composite prism structure.

The sleeve 103 acts as a spring. Specifically, when the stanchion 102 and the shoelace 141 insert into the sleeve 103, a radial force is applied to the sleeve 103 in a direction perpendicular to the center axis of the sleeve 103. The applied radial force elongates the span of the diameter of the sleeve 103 in the direction perpendicular to the center axis of the sleeve 103. The elasticity of the sleeve 103 creates a force that opposes the displacement created by the applied force. The elasticity of the sleeve 103 returns the sleeve 103 to its relaxed shape. The stanchion 102 and the shoelace 141 will prevent the sleeve face 134 of the sleeve 103 from returning to its relaxed shape. In this circumstance, the sleeve face 134 of the sleeve 103 will apply a force projecting radially towards the center axis of the sleeve 103 that binds sleeve 103 to the stanchion 102 and the shoelace 141.

The sleeve 103 is further defined with a fixed end 132, a free end 133, and a sleeve face 134. The fixed end 132 refers to the end of the cylindrical structure of the sleeve 103 that attaches to the stanchion 102 at a location proximal to the superior end 123. The fixed end 132 is permanently attached to the stanchion face 124 of the stanchion 102. The free end 133 is the end of the plurality of lace apertures 131 that is distal from the fixed end 132. The sleeve face 134 refers to the surface structure of the sleeve 103 that joins the fixed end 132 to the free end 133. The sleeve face 134 is an elastic surface.

The fixed end 132 of the sleeve 103 attaches to the stanchion face 124 of the stanchion 102 at a location proximal to the superior end 123 of the stanchion 102. The sleeve 103 everts onto and off of the stanchion 102 by rolling the free end 133 of the sleeve 103 over the stanchion face 124 of the stanchion 102.

The sleeve 103 further comprises a plurality of lace apertures 131. Each of the plurality of lace apertures 131 is an aperture formed through the sleeve face 134 of the sleeve 103 into the hollow interior of the sleeve 103. Each of the plurality of lace apertures 131 provides an opening through the sleeve 103, which provides a tip of the shoelace 141 access to a lace port selected from the plurality of lace ports 121 of the stanchion 102. There is a one to one correspondence between the plurality of lace apertures 131 and the plurality of lace ports 121. The plurality of lace apertures 131 are positioned on the sleeve face 134 of the sleeve 103 such that each of the plurality of lace apertures 131 aligns with the corresponding lace port selected from the plurality of lace ports 121.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Anchor: As used in this disclosure, anchor means to hold an object firmly or securely.

Anchor Point: As used in this disclosure, an anchor point is a location to which a first object can be securely attached to a second object.

Compress: In this disclosure, compress means to force into a smaller space.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Cone: As used in this disclosure, a cone is a surface that is generated by rotating a triangle around one of the legs of the triangle. If a line that is perpendicular to the base that is drawn from the center of the base goes through the vertex of the triangle then the cone is called a right cone. A cone is a type of quadric surface. The cone is a pyramid with a circular base. The cone is further defined with an apex, a base, and a lateral face.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object. Always use Geometrically similar, correspond and one to one Cord: As used in this disclosure, a cord is a long, thin, flexible, and prism-shaped string, line, rope, or wire. Cords are made from yarns, piles, or strands of material that are braided or twisted together or from a monofilament (such as fishing line). Cords have tensile strength but are too flexible to provide compressive strength and are not suitable for use in pushing objects. String, line, cable, and rope are synonyms for cord.

Correspond: As used in this disclosure, the term correspond is used as a comparison between two or more objects wherein one or more properties shared by the two or more objects match, agree, or align within acceptable manufacturing tolerances.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Elastic: As used in this disclosure, an elastic is a material or object that deforms when a force is applied to it and that is able to return to its relaxed shape after the force is removed. A material that exhibits these qualities is also referred to as an elastomeric material. A material that does not exhibit these qualities is referred to as inelastic or an inelastic material.

Eversion: As used in this disclosure, eversion refers to the process of turning an object inside out. The verbal form of eversion is to evert. An object that can undergo an eversion is said to be evertable.

Footwear: As used in this disclosure, footwear refers to a protective structure that is worn on a foot. Footwear is commonly referred to as a shoe.

Form Factor: As used in this disclosure, the term form factor refers to the size and shape of an object.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Hourglass Shape: As used in this disclosure, the hourglass shape refers to a roughly prism-shaped structure wherein the diameter of the lateral face of the prism varies such the lateral face narrows between the two ends of the prism to a diameter less than the diameter of each of the ends of the prism. The hourglass shape is known for a characteristic wide-narrow-wide appearance.

Inner Dimension: As used in this disclosure, the term inner dimension describes the span from a first inside or interior surface of a container to a second inside or interior surface of a container. The term is used in much the same way that a plumber would refer to the inner diameter of a pipe.

Intermediate: As used in this disclosure, the term intermediate refers to a location that lies between a first object and a second object.

Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

N-gon: As used in this disclosure, an N-gon is a regular polygon with N sides wherein N is a positive integer number greater than 2.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load-bearing structure that that transfers a load between a between two objects or structures.

Polygon: As used in this disclosure, a polygon refers to a closed planar figure comprising three or more sides. Any two adjacent sides selected from the three or more sides attach to each other such that the two adjacent sides form an interior arc with a cant of less than 180 degrees. A regular polygon is defined as a polygon wherein: a) the span of the length of any side selected from the three or more sides equals the span of the length of any unselected side remaining in the three or more sides; and, b) the arc of the cant between any two adjacent sides selected from the three or more sides equals the arc of the cant of any two unselected sides remaining in the three or more sides. Polygons are often referred to as N-gons where N refers to the number of sides. For example, a pentagon has five sides, and a hexagon has six sides.

Pressure: As used in this disclosure, pressure refers to a measure of force per unit area.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Pyramid: As used in this disclosure, a pyramid is a three-dimensional shape that comprises a base formed in the shape of an N-gon (wherein N is an integer) with N triangular faces that rise from the base to converge at a point above the base. If the point where the N faces meet is positioned such that a line drawn from the point where the N faces meet to the center of the N-gon base is perpendicular to the N-gon base, the pyramid is referred to as a right pyramid. Pyramids can be further formed with circular or elliptical bases, which are commonly referred to as cone or an elliptical pyramid respectively. A pyramid is defined with a base, an apex, and a lateral face. The base is the N-gon shaped base described above. The apex is the convergence point described above. The lateral face is formed from the N triangular faces described above.

Relaxed Shape: As used in this disclosure, a structure is considered to be in its relaxed state when no shear, strain, or torsional forces are being applied to the structure.

Rigid Structure: As used in this disclosure, a rigid structure is a solid structure formed from an inelastic material that resists changes in shape. A rigid structure will permanently deform as it fails under a force.

Sleeve: As used in this disclosure, a sleeve is a tube-like covering that is placed over a rod, shaft or other cylindrical object.

Spool: As used in this disclosure, a spool is a cylindrical device upon which a flexible material, including but not limited to a yarn, a cord, or a tape, can be wound. Depending on context, a spool may also contain the flexible material stored upon the spool.

Spring: As used in this disclosure, a spring is a device that is used to store mechanical energy. This mechanical energy will often be stored by: 1) deforming an elastomeric material that is used to make the device; 2) the application of a torque to a semi-rigid structure; or 3) a combination of the previous two items.

Stanchion: As used in this disclosure, a stanchion refers to a vertical pole, post, or support.

Truncated: As used in this disclosure, a geometric object is truncated when an apex, vertex, or end is cut off by a line or plane.

Truncated Cone: As used in this disclosure, a truncated cone is a frustum that remains when the apex of a cone is truncated by a plane that is parallel to the base of the cone.

Tube: As used in this disclosure, the term tube is used to describe a hollow cylinder with two open ends. While tubes are often used to transport or conveys fluids or gases, the purpose of the tubes in this disclosure is structural. In this disclosure, the terms inner dimension and outer dimension of a tube are used as they would be used by those skilled in the plumbing arts.

Wind: As used in this disclosure, to wind refers to making a rotational movement that used to: a) load a cord on a spool; or, b) to tighten a torsion spring.

With respect to the above description, it is to be realized that the optimum dimensional relationship for the various components of the invention described above and in FIGS. 1 through 7 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A fastening device for footwear comprising:
- a pedestal, a stanchion, and a sleeve;
- wherein the stanchion attaches the pedestal to the sleeve;
- wherein the fastening device for footwear is configured for use with a shoelace;
- wherein the shoelace is configured for use with a shoe;
- wherein the shoelace is further defined with tips;
- wherein the fastening device for footwear holds the shoelace in position;
- wherein the shoelace is a cord;
- wherein the shoelace is wound around the stanchion during a tightening process;
- wherein the pedestal is configured to transfer the load of the fastening device for footwear to the surface of the shoe;
- wherein the stanchion is further defined with an inferior end, a superior end, and a stanchion face;
- wherein the stanchion further comprises a plurality of lace ports;
- wherein each of the plurality of lace ports is an aperture formed through the stanchion face of the stanchion into a hollow interior of the stanchion;
- wherein the sleeve encloses the shoelace and the stanchion;
- wherein the sleeve compresses the shoelace against the stanchion;
- wherein the pedestal is a rigid structure;
- wherein the pedestal has the shape of a truncated cone;
- wherein the pedestal is further defined with a base, a truncated apex, and a pedestal face;
- wherein the stanchion is a rigid structure
- wherein the stanchion is a hollow cylindrical structure;
- wherein the sleeve is a hollow tube structure;
- wherein the sleeve is further defined with a fixed end, a free end, and a sleeve face.

2. The fastening device for footwear according to claim 1 wherein the sleeve is an elastomeric structure.

3. The fastening device for footwear according to claim 2 wherein the sleeve has a shape selected from the group consisting of a cylindrical structure and an hourglass structure.

4. The fastening device for footwear according to claim 3 wherein the stanchion attaches to the pedestal to form a composite prism structure.

5. The fastening device for footwear according to claim 4 wherein the truncated apex of the pedestal attaches to the inferior end of the stanchion.

6. The fastening device for footwear according to claim 5 wherein the sleeve is formed from an elastic sheeting.

7. The fastening device for footwear according to claim 6 wherein the sleeve attaches to the stanchion to form a composite prism structure.

8. The fastening device for footwear according to claim 7 wherein the sleeve is a spring;

wherein the sleeve face of the sleeve binds the sleeve to the stanchion and the shoelace.

9. The fastening device for footwear according to claim 8 wherein the fixed end attaches to the stanchion at a location proximal to the superior end.

10. The fastening device for footwear according to claim 9 wherein the fixed end is permanently attached to the stanchion face.

11. The fastening device for footwear according to claim 10 wherein the sleeve everts onto and off of the stanchion.

12. The fastening device for footwear according to claim 11 wherein the sleeve further comprises a plurality of lace apertures;

wherein each of the plurality of lace apertures is an aperture formed through the sleeve face of the sleeve into the hollow interior of the sleeve.

13. The fastening device for footwear according to claim 12 wherein each of the plurality of lace apertures provides an opening through the sleeve which provides the tips of the shoelace access to one or more lace ports selected from the plurality of lace ports.

14. The fastening device for footwear according to claim 13 wherein there is a one to one correspondence between the plurality of lace apertures and the plurality of lace ports;

wherein the plurality of lace apertures are positioned on the sleeve face of the sleeve such that each of the plurality of lace apertures aligns with the corresponding lace port selected from the plurality of lace ports.

* * * * *